US011767669B2

(12) United States Patent
Churchman et al.

(10) Patent No.: US 11,767,669 B2
(45) Date of Patent: Sep. 26, 2023

(54) SYSTEM AND METHOD OF INSTALLING SYSTEM OF SHEETS OF SHEATHING HAVING LASER ENGRAVED AND/OR RASTERBATED IMAGE OF BUILDING INFORMATION

(71) Applicants: Patrick Churchman, Meridian, ID (US); Nicholas Stoppello, Meridian, ID (US)

(72) Inventors: Patrick Churchman, Meridian, ID (US); Nicholas Stoppello, Meridian, ID (US)

( * ) Notice: Subject to any disclaimer, the term of this patent is extended or adjusted under 35 U.S.C. 154(b) by 150 days.

(21) Appl. No.: 17/185,911

(22) Filed: Feb. 25, 2021

(65) Prior Publication Data

US 2021/0262221 A1 Aug. 26, 2021

Related U.S. Application Data

(60) Provisional application No. 62/981,286, filed on Feb. 25, 2020.

(51) Int. Cl.

| | |
|---|---|
| ***E04G 21/18*** | (2006.01) |
| ***E04B 1/35*** | (2006.01) |
| ***E04B 5/02*** | (2006.01) |
| ***G09F 23/00*** | (2006.01) |
| ***E04C 2/52*** | (2006.01) |

(52) U.S. Cl.

CPC ..... *E04B 1/35* (2013.01); *E04B 5/02* (2013.01); *E04C 2/526* (2013.01); *G09F 23/00* (2013.01); *E04B 2001/3572* (2013.01)

(58) Field of Classification Search

CPC ..... E04B 1/35; E04B 5/02; E04B 2001/3572; E04C 2/526; G09F 23/00

USPC ..... 52/105

See application file for complete search history.

(56) References Cited

U.S. PATENT DOCUMENTS

| | | | | |
|---|---|---|---|---|
| 3,816,931 | A | 6/1974 | LaMar | |
| 5,755,072 | A | 5/1998 | Lingafelter | |
| 5,950,319 | A | 9/1999 | Harris | |
| 6,253,504 | B1 * | 7/2001 | Cohen | E04B 1/35 52/143 |
| 7,318,299 | B2 | 1/2008 | Chambers | |
| 8,533,927 | B2 | 9/2013 | Atherton et al. | |
| 10,317,184 | B1 | 6/2019 | Keller | |
| 10,538,927 | B1 * | 1/2020 | Keller | E04F 21/00 |
| 2003/0061722 | A1 | 4/2003 | Bradley | |
| 2006/0265969 | A1 * | 11/2006 | Broderick | A47F 10/00 52/36.1 |

(Continued)

*Primary Examiner* — Brian E Glessner
*Assistant Examiner* — James J Buckle, Jr.

(57) ABSTRACT

A system and method for installing the system of sheathing panels having building information applied to the individual sheets of sheathing prior to installation. Application of the building information is performed by printing the information directly on each sheet to form a rasterbated image of the building plan. The rasterbated image is then assembled as the surface of a building to provide a building plan integrated into the surface of the building. The information provided by the building plan can include, but is not limited to, plumbing information, heating, ventilation, and air conditioning information, electrical information, and framing information, including but not limited to information regarding the composition of walls, and placement, size and configuration of windows and doors.

16 Claims, 12 Drawing Sheets

(56) References Cited

U.S. PATENT DOCUMENTS

| | | | | |
|---|---|---|---|---|
| 2007/0068114 | A1* | 3/2007 | Caretto | E04G 21/1833 52/741.1 |
| 2007/0190496 | A1* | 8/2007 | Lamb | G09B 25/04 434/72 |
| 2009/0277031 | A1 | 11/2009 | Stocking | |
| 2013/0074350 | A1* | 3/2013 | Le Mer | B63B 71/00 33/286 |
| 2016/0208502 | A1 | 7/2016 | Onchuck et al. | |
| 2018/0023309 | A1* | 1/2018 | Brawner | E04H 1/1205 52/745.06 |

* cited by examiner

SYSTEM AND METHOD OF INSTALLING SYSTEM OF SHEETS OF SHEATHING HAVING LASER ENGRAVED AND/OR RASTERBATED IMAGE OF BUILDING INFORMATION

PRIORITY/CROSS-REFERENCE TO RELATED APPLICATIONS

This application claims the benefit of U.S. Provisional Application No. 62/981,286, filed Feb. 25, 2020 the disclosure of which is incorporated by reference.

TECHNICAL FIELD

The presently disclosed technology relates to a system and method of providing a building plan on a surface of a building under construction. More particularly, the present invention is a system and method of applying the system of a plurality of sheets of sheathing having a laser engraved and/or rasterbated image applied thereto and installing the system of sheets of sheathing to provide a full size building plan.

BACKGROUND

Typical stud frame building, including stick frame and metal frame houses, construction utilizes a frame overlayed with sheathing to form flooring, walls, ceiling, and roofs. This includes, but is not limited to, exterior wall sheathing, internal wall sheathing, ceiling sheathing, and roof sheathing. In a typical construction, the floor of each level of a building is formed by a subfloor overlayed on framing. Framing of the walls of the level are then attached to the subfloor, with the floor finished by a finishing layer applied over the subfloor and sheathing being attached to the framing of the walls. Typical sub-flooring utilizes oriented strand board ("OSB") or plywood, although other materials can be utilized, while internal wall sheathing is typically gypsum based sheathing, such as drywall, that is attached directly to the framing to provide internal walls, whereas typically OSB sheathing, or other sheathing, is applied to the frame to provide for external walls. Roof sheathing is typically constructed of a layer of sheathing with a weatherproofing layer such as shingles or metal sheets applied over the sheathing. Similarly, external walls are typically formed by a sub-sheathing with a weatherproofing layer, such as siding, applied over the sub-sheathing.

Typically utilities such as plumbing, electrical, heating, and cooling are installed in the framing of the building with access provided through openings in the subflooring. Similarly venting of the airspace within the building as well as the plumbing system occurs through piping in the framing, with vent outlets provided through the roof and/or external walls of the home.

Typical construction utilizes a series of building plans or plans that depict, for example, the framing, plumbing, mechanical, and electrical of the building to be built. The plans are typically utilized by a framer to frame the walls, an electrician to install the electrical system, or typically by each respective specialist. In standard building practice each uses the building plans separately thus providing potential for error in how each interprets the building plans. Further, it takes time for each to interpret the building plan and determine what must be installed where. What is needed is a method and system that provides building information preinstalled in the sheathing that makes up floors, walls, ceiling, and roofs to avoid translation issues between hand-held or electronic building plans or plans and installation of the physical manifestation of the information contained in the building plans or plans.

SUMMARY OF THE DISCLOSURE

The purpose of the Summary is to enable the public, and especially the scientists, engineers, and practitioners in the art who are not familiar with patent or legal terms or phraseology, to determine quickly from a cursory inspection, the nature and essence of the technical disclosure of the application. The Summary is neither intended to define the inventive concept(s) of the application, which is measured by the claims, nor is it intended to be limiting as to the scope of the inventive concept(s) in any way.

In accordance with the present invention, a new and improved method for modularizing and printing custom building information on sheets of sheathing that are to be used as a wall, floor, ceiling or roof in an order format so as to provide the building plan in a full scale form on the actual substrate of the building. The term sheathing is utilized as the sheets of sheathing provide a sheathing for the underlying frame of the building, whether steel, wood, concrete, or other building material. For example, subfloor sheets (typically plywood, oriented strand board ("OSB"), or any other construction used in subfloor construction) that are arrangeable in a grid to provide a system of subfloor sheets that map out the building material to be constructed on the subfloor. More particularly in accordance with the invention, the subfloor sheets display building information in predetermined locations to layout the floor plan to inform a construction worker of additional construction positioning, including but not limited to, framing, plumbing and electrical information. This can apply to sheathing for external walls, including both sheathing applied to the framing as well as weatherproofing, such as siding, roofing material including the roof substrate, internal wall and/or ceiling material including drywall and tile backer board, and any other substrate utilized in the building process. The process of tile printing of artwork into individual tiles that are assembled to form an image is commonly referred to as "rasterbating," with the verb "to rasterbate" meaning to tile print an image. The most used OSB, plywood, and drywall panels are 4'×8', with varying sizes available particularly in drywall.

In one embodiment, the information on each sheathing sheet is printed prior to arriving at the construction site. The printer preferably uses pre-designed building plans to print out the floor plan on the subfloor sheet. If shipped, the subfloor sheets preferably are shipped to the construction site stacked in order in accordance with the preferred layout.

In a preferred embodiment, a building plan, plan, or similar map showing the installation sequence of the subfloor sheets is provided to a builder for correctly positioning the appropriate subfloor sheet. The subfloor sheets are arranged adjacent to corresponding sheets to create a subfloor having in essence a map of materials to be added to the floor. Once the subfloor is installed, the construction can proceed without having to install further mapping, such as setting chalking for the location of walls.

A variety of information can be printed onto the sheets. This information includes, but is not limited to, structural hold downs and shear wall locations, plumbing fixture, vent and waste locations, overhead structural information such as beams, header, and header support information, floor to floor penetrations and chase locations, special construction items, bocking and/or ADA requirements such as wheelchair turn radiuses or clear floor space requirements, and special contractor or designer notes. Specific examples of information that can be included in the preprinted information includes the wall type, location and layout, the number of each door for coordinating with installation, the location and swing direction, location of fire alarm and/or sprinkler locations, electrical and low voltage locations, overhead lighting fixture location and identification, overhead framing and soffit locations and heights, window locations including rough opening sizes, Still other features and advantages of the presently disclosed and claimed inventive concept(s) will become readily apparent to those skilled in this art from the following detailed description describing preferred embodiments of the inventive concept(s), simply by way of illustration of the best mode contemplated by carrying out the inventive concept(s). As will be realized, the inventive concept(s) is capable of modification in various obvious respects all without departing from the inventive concept(s). Accordingly, the drawings and description of the preferred embodiments are to be regarded as illustrative in nature, and not as restrictive in nature.

DETAILED DESCRIPTION OF THE FIGURES

Figure 1:
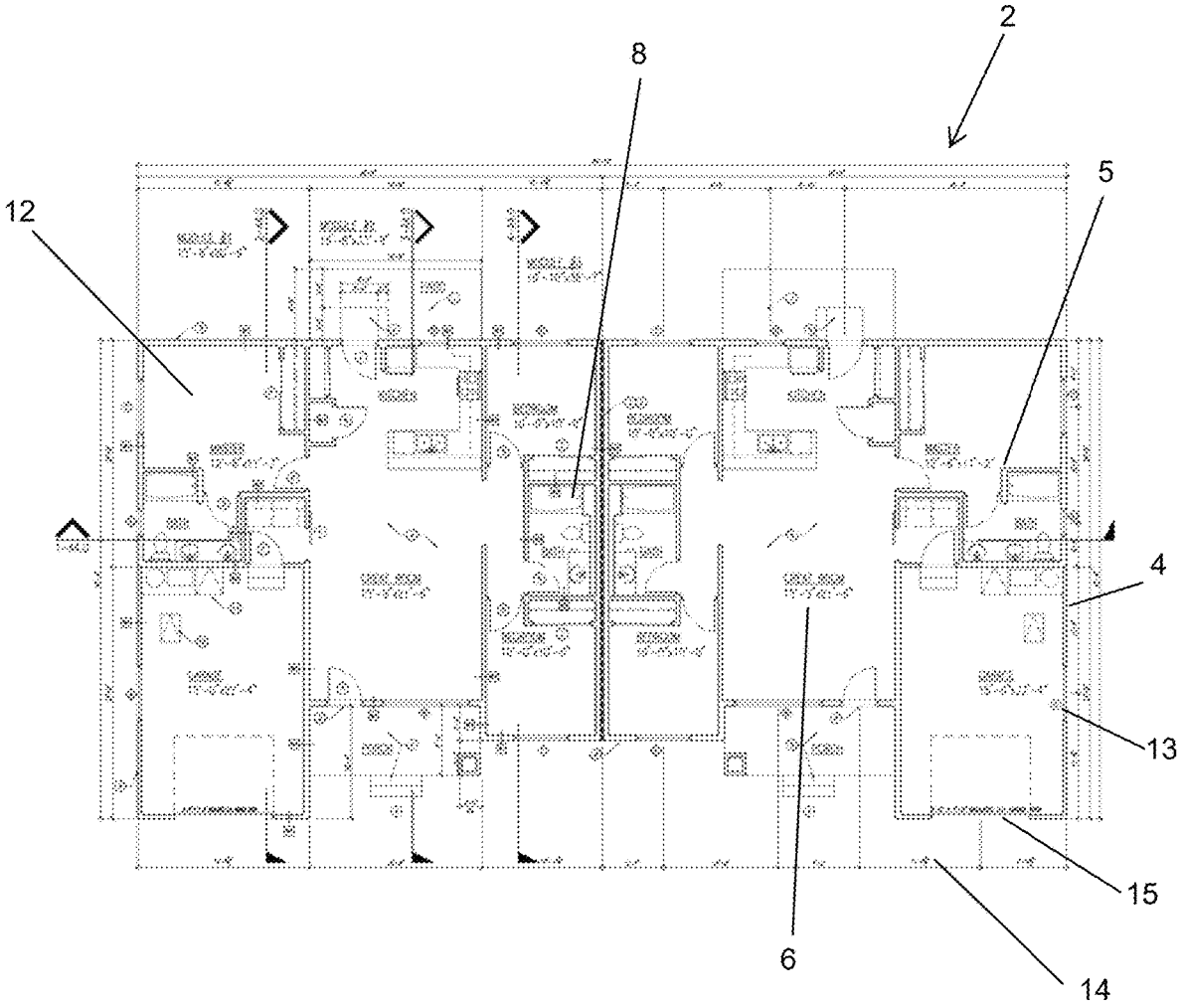
FIG. 1 is an example building plan.

While the presently disclosed inventive concept(s) is susceptible of various modifications and alternative constructions, certain illustrated embodiments thereof have been shown in the drawings and will be described below in detail. It should be understood, however, that there is no intention to limit the inventive concept(s) to the specific form disclosed, but, on the contrary, the presently disclosed and claimed inventive concept(s) is to cover all modifications, alternative constructions, and equivalents falling within the spirit and scope of the inventive concept(s) as defined in the claims.

FIG. 1 illustrates a standard embodiment of a building plan. The building plan 2 illustrates the series of exterior walls 4 and interior walls 5 defining a series of rooms within the building. These rooms include bedrooms, bathrooms 8 and great rooms 6. The building plan is typically used as a map or guide from which to build a structure. The building plan often includes information such as framing information for constructing the walls, information regarding the placement of openings in the interior 13, 15 and the exterior walls.

Figure 2:
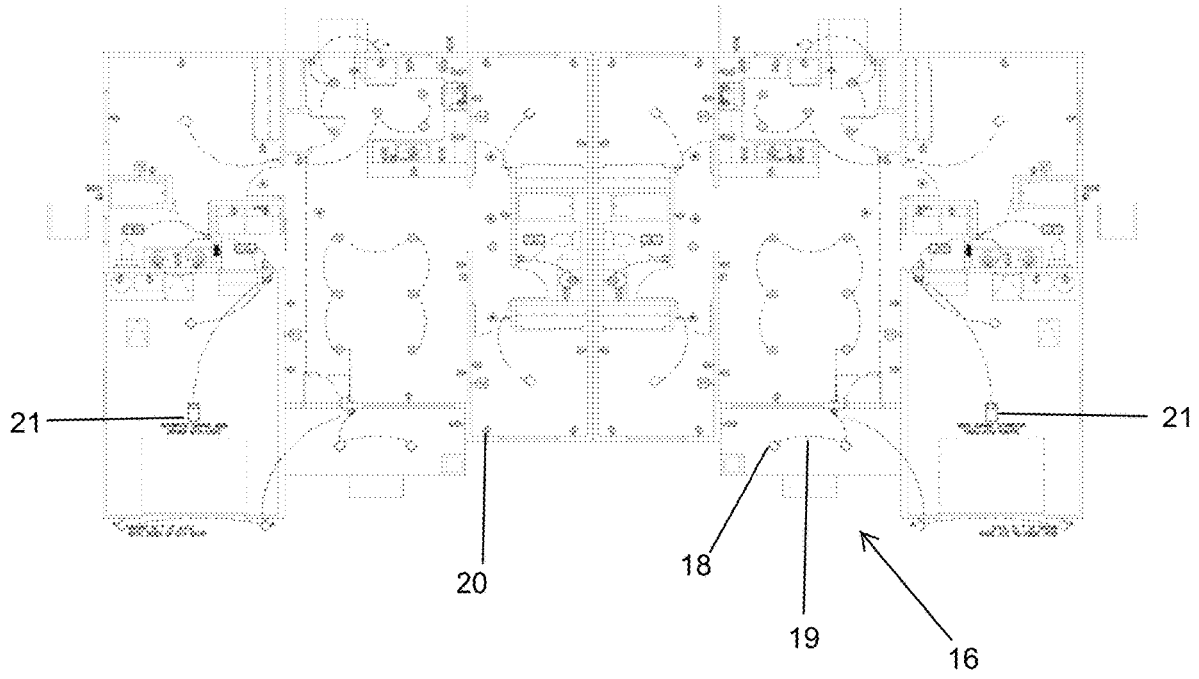
FIG. 2 is the building plan of FIG. 1 showing electrical layout of the plan of FIG. 1.

FIG. 2 illustrates a building plan of the building shown in FIG. 1 but showing with electrical layout indicated overhead lights 18 are shown connected by wiring 19. Electrical outlets 20 are shown as are garage door openers 21.

Typically a builder utilizes plans such as those depicted in FIGS. 1 and 2 when constructing a building. The builder utilizes measurements 14 shown to determine the location of exterior openings 15, 13 in the walls of the building. The measurements allow the builder to correctly frame the rough openings of the building for doors and windows to subsequently be replaced. The building plans allow for plumbers, electricians, and other trades people to install utilities throughout the home and construction.

Figure 3:
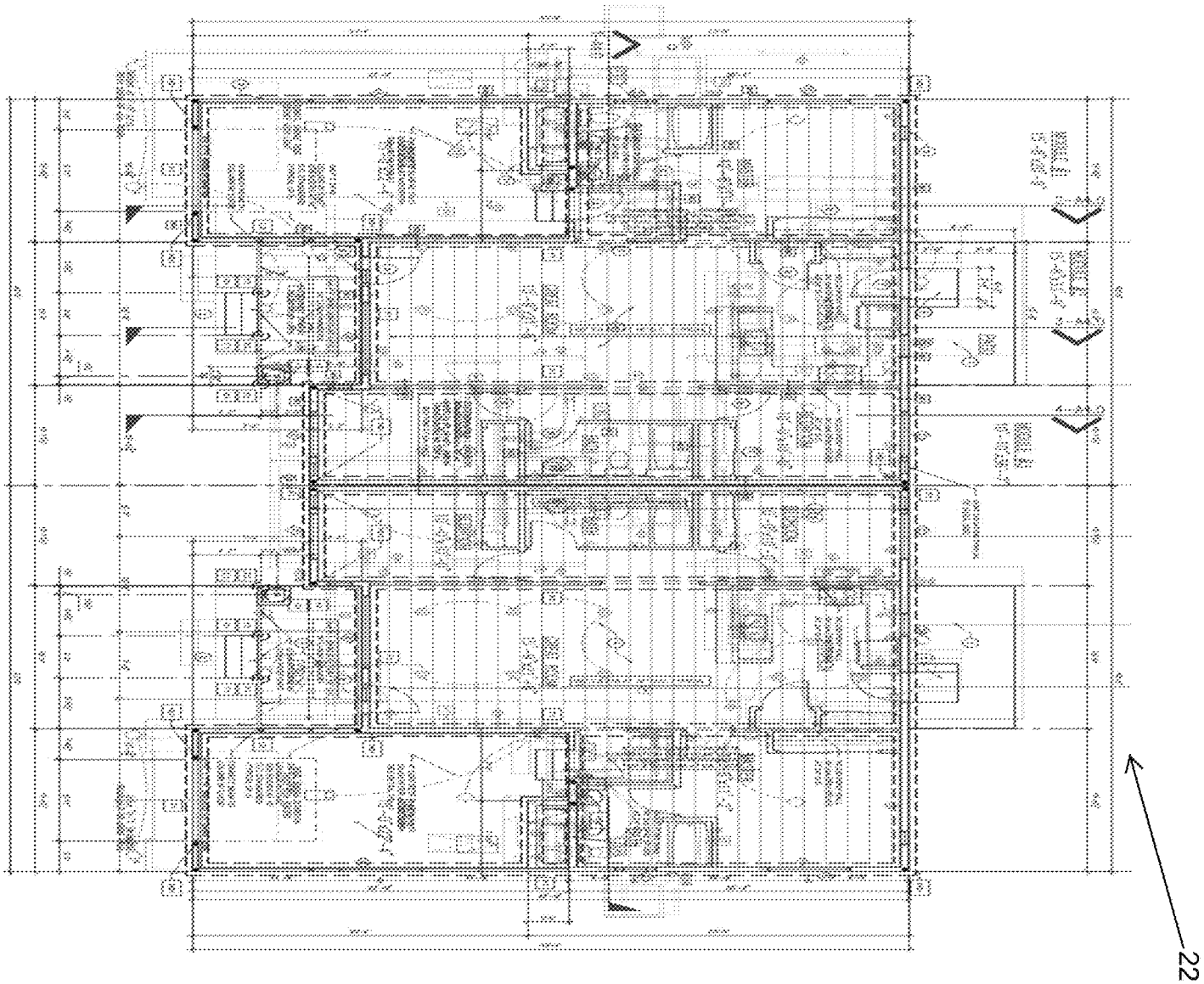
FIG. 3 illustrates an overlayment of FIG. 2 and FIG. 1 to provide a complete plan.

FIG. 3 illustrates an overlay of FIG. 2 and FIG. 1. The overlayment allows the full plan to be shown including electrical FIG. 2 with FIG. 1. Multiple plans can be utilized or alternatively if the plan has been created in a single, complete form only an original plan can be utilized.

Figure 4:
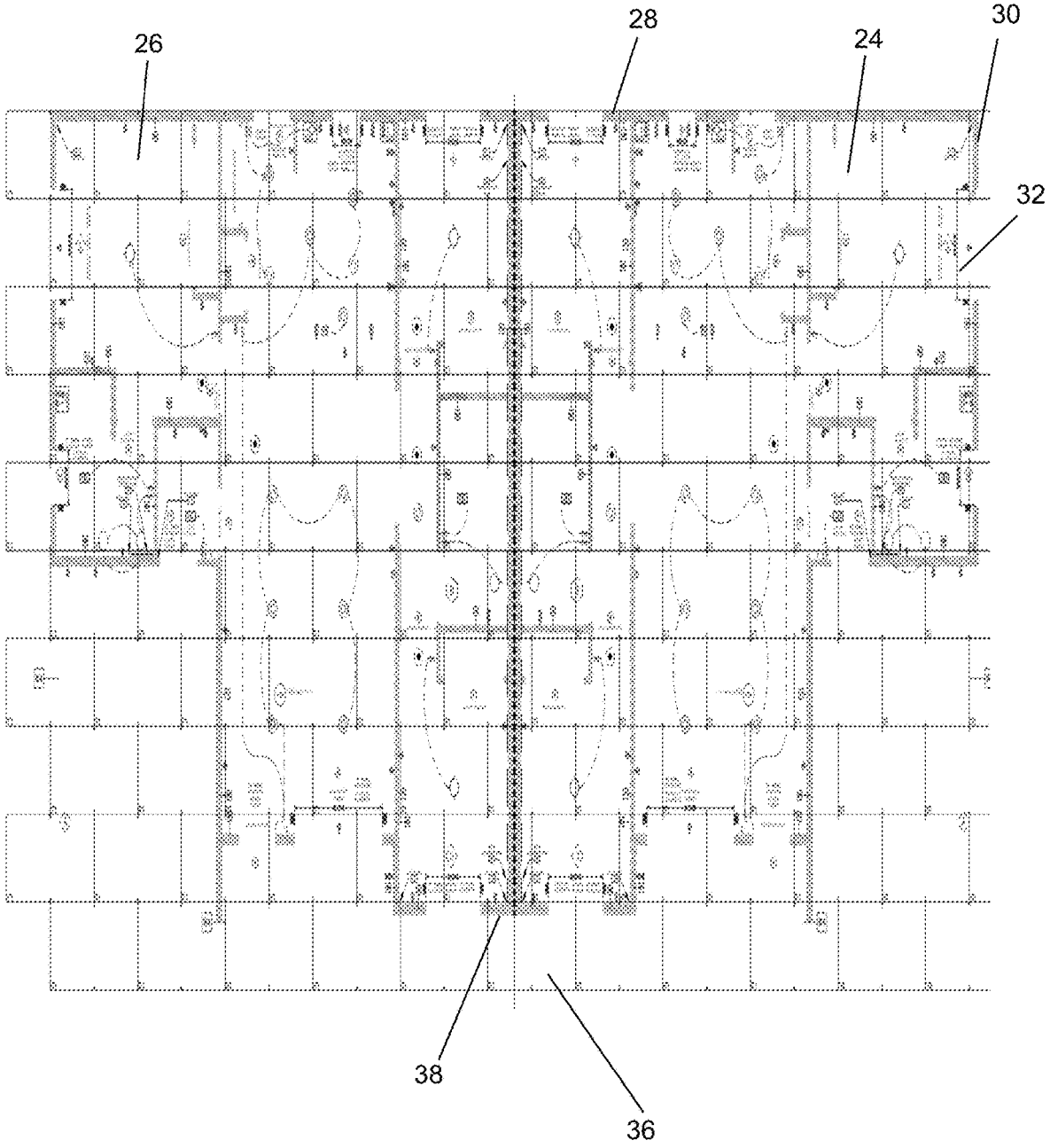
FIG. 4 illustrates the plan of FIG. 1 overlayed on a graph system of sub-floor material.

FIG. 4 illustrates FIG. 3 with a grid pattern in an initial step of rasterbation to illustrate the varying parts of FIG. 3 to be printed on individual sheets 24, 26 of sheathing. FIG. 4 is provided digitally to the printer, with each sheet of sheeting printed individually. Each sheet is given an identifier to identify where in the grid the sheet is to be positioned. In the depicted embodiment, each row is provided with a letter designation with each tile provided with a numerical designation to designate order within the row. The sheathing is provided in rows 30, 32 that are overlapped as in a standard subfloor. While the depiction of FIG. 4 is illustrated in a subfloor, a similar overlayment can be utilized for other sheathing utilized in construction such as drywall sheathing, exterior wall sheathing, roof sheathing, and internal wall sheathing such as drywall. Partial sheathing sections 36 are shown in which the floor plan partial overlaps 38 onto the sheathing. Excess sheathing is subsequently removed.

Figure 5:
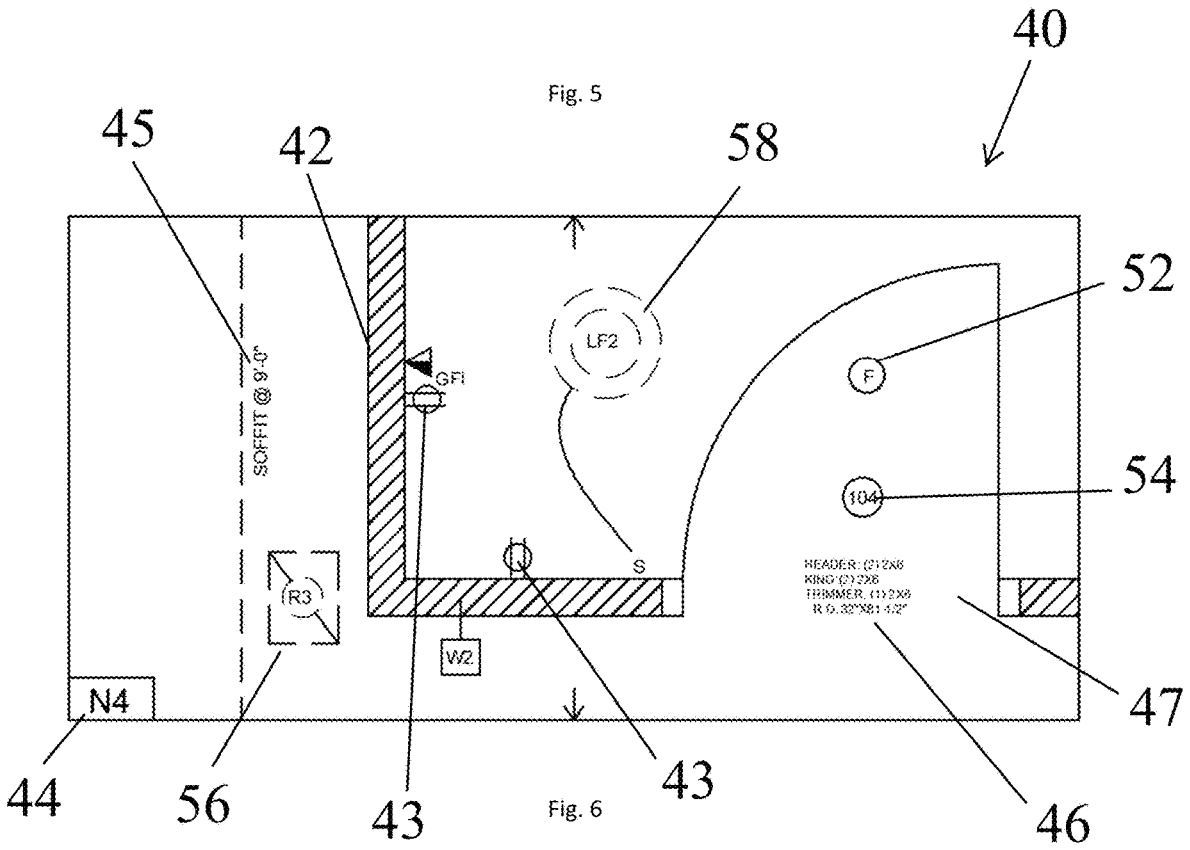
FIG. 5 illustrates an individual sheet of sub-floor sheathing illustrating building markings.

FIG. 5 illustrates an individual sheet of sheathing. The depiction of FIG. 5 is for sub-floor sheathing. The sheathing piece 40 illustrates wall information 42, electrical information 43. Heating, ventilation and air conditioning (HVAC) information 56 is provided. Information 60 regarding the rough opening 47 is printed on the sheathing including information regarding the header for load distribution around the opening. King studs are designated as well as trimmer studs. The size of the rough openings is shown as 32 inches by 38.5 inches. Roof information 45 is shown regarding the overhang of the soffit above the sheathing element. Fire alarm information 52, door number, location and swing direction 54. Overhead lighting information 58 is provided. The sheathing element includes an indicator N4 illustrating the positioning in the grid overlayment shown in FIG. 4 indicating row and column.

Preferably the individual sheets of sheathing have the building information printed directly to the sheathing prior to transport to the building site, although a mobile embodiment can be provided. In a preferred embodiment the individual sheets of sheathing 50 are provided with indicators as shown in FIG. 5 as to the location of each individual sheet of sheathing relative to other sheets. A map of the rasterbated image is also provided to the construction assembly crew for proper layout of the individual sheets of sheathing.

Figure 6:
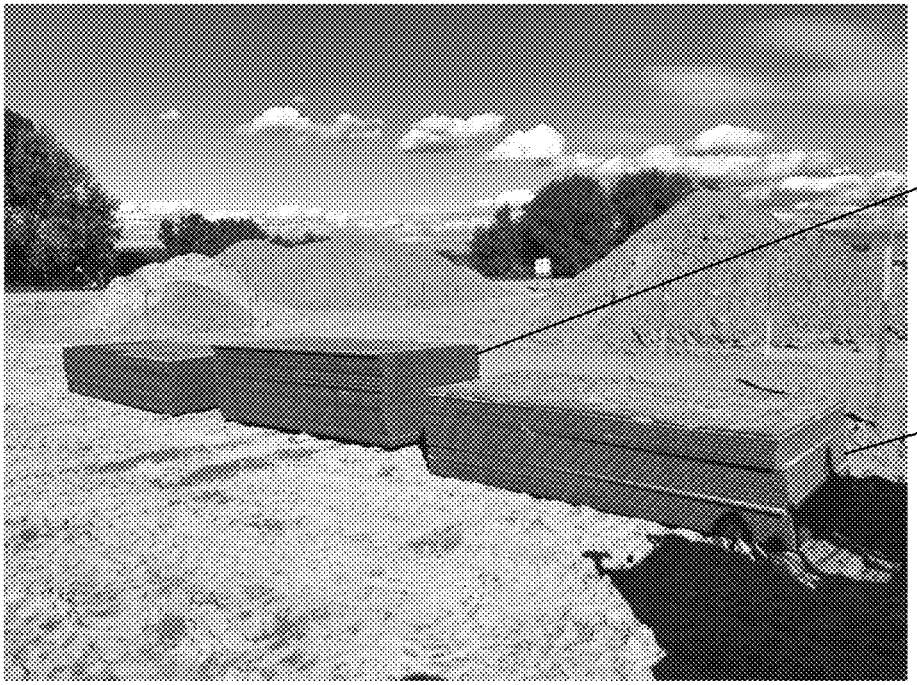
FIG. 6 illustrates three stacks of sheets of sub-floor sheathing prior to installation.

FIG. 6 illustrates three stacks of sheets of sheathing at a building site. The individual sheets of sheathing are provided with an indicator that can be utilized with the map or key of FIG. 7. Assembly of the individual sheets of sheathing into a completed structure provides a plan embedded on the structure that can subsequently be utilized to assemble further components of the building.

Figure 7:
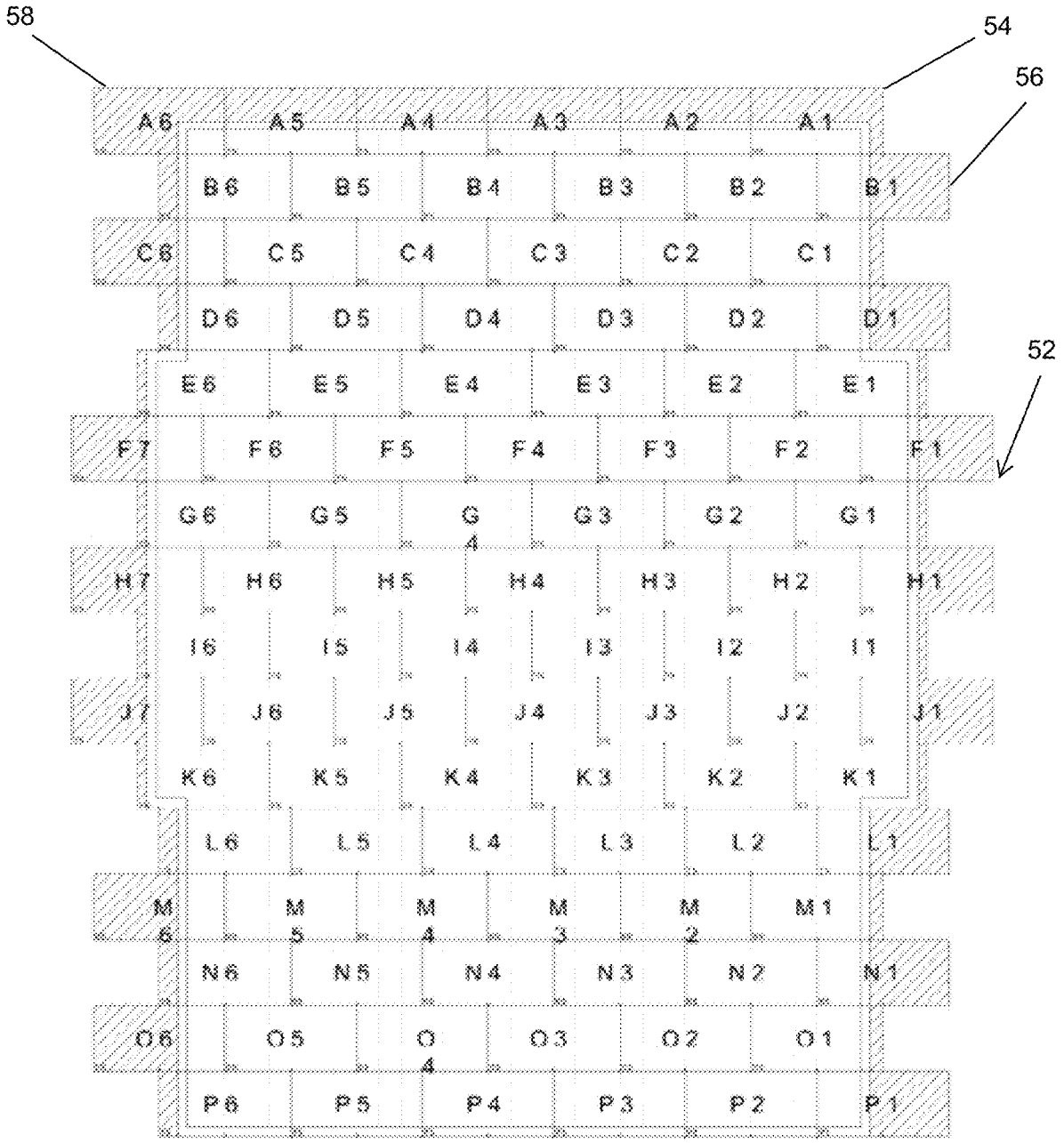
FIG. 7 illustrates a map or key for use in assembling sheets of sheathing having pre-printed building information thereon.

FIG. 7 illustrates an example map of the overlay layout of the rows of individual sheathing to form the overall layout of the plan. Alternating horizontal rows 54, 56 are provided with differing numbers A-P with the position of each individual sheathing within the row indicated by number. The key 52 to reassembling the rasterbated image is then utilized to then assemble the individual sheets.

Figure 8:
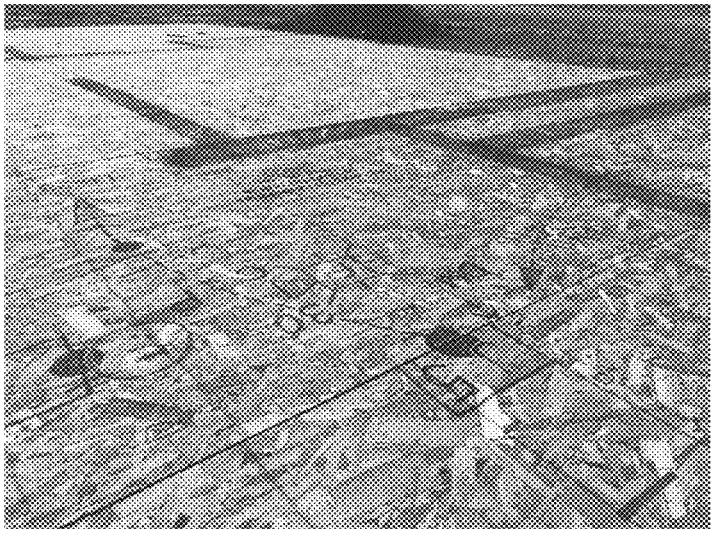
FIG. 8 illustrates a perspective view of sheets of sheathing having pre-printed building information thereon assembled as a sub-floor.

FIG. 8 is a perspective view of a system utilizing a series of sheets of sheathing having building information preprinted thereon. In a preferred embodiment the information is printed thereon including by engraving and/or by printing such as printing. For example, preferably the engraving is done by a laser engraving, such as by a boss LSR hybrid laser engraver.

Figure 9:
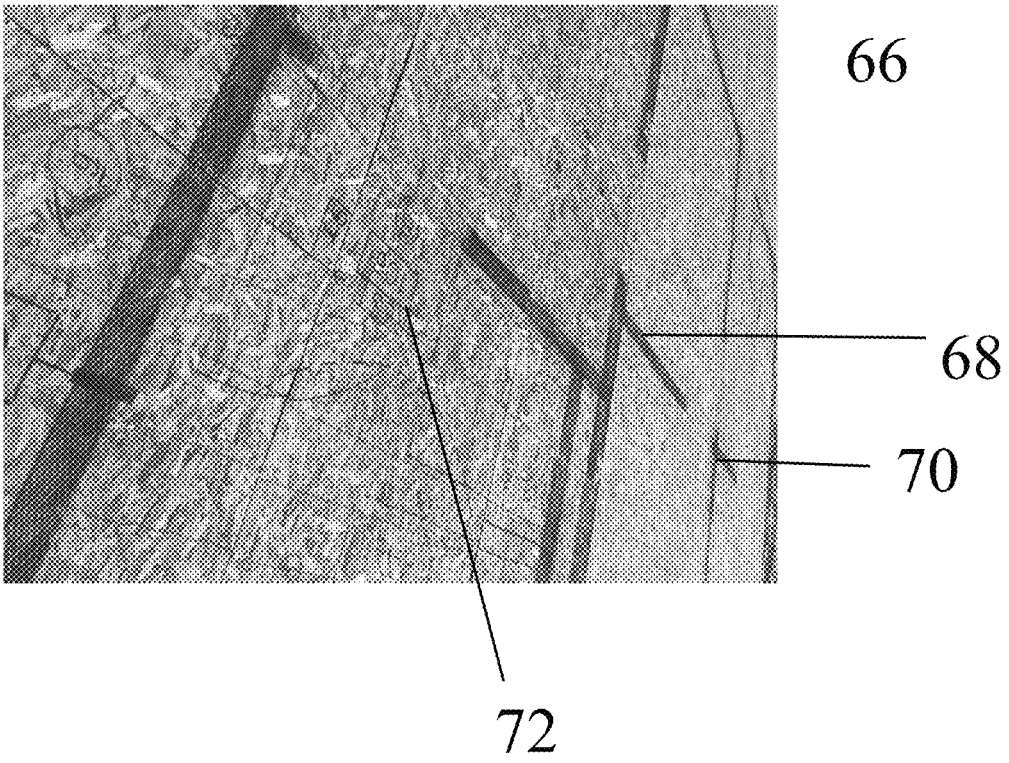
FIG. 9 illustrates a series of sheets of sheathing having pre-printed building information assembled as a sub-floor.

FIG. 9 illustrates a perspective view of a series of sheathing of a sub-floor having pre-printed building information positioned thereon. Interior wall 68, 70 are depicted with information regarding the layout 72 shown on the individual sheathing. Individual sheets of sheathing are shown meeting at junctures 66.

Figure 10:
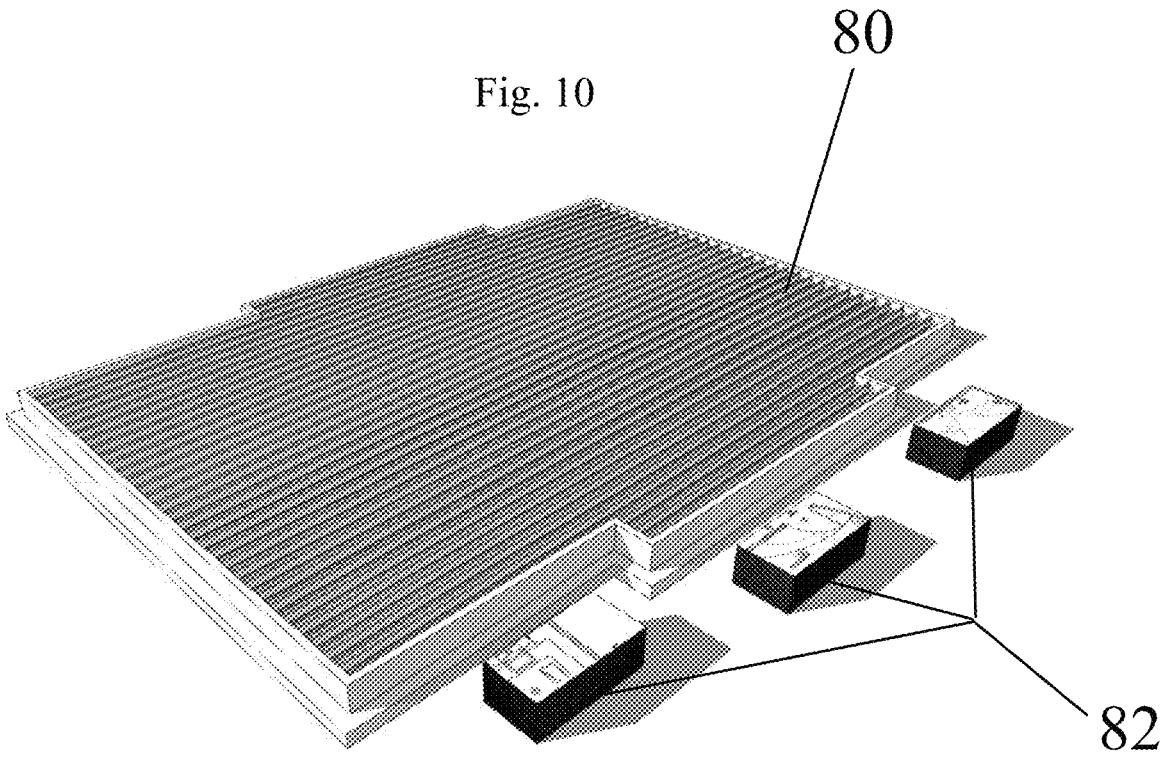
FIG. 10 illustrates the floor flaming of a building with three stacks of sheets of sub-floor sheathing for installation on the floor framing.

FIG. 10 illustrates a perspective view of the framing 80 of a floor of a building. Three stacks 82 of sheets of sub-floor sheathing are positioned next to the framing. The stacks of subfloor sheathing each have a printed section of the building plan to be assembled to depict a full scale building plant when assembled as a complete-sub floor, as depicted in FIG. 12.

Figure 11:
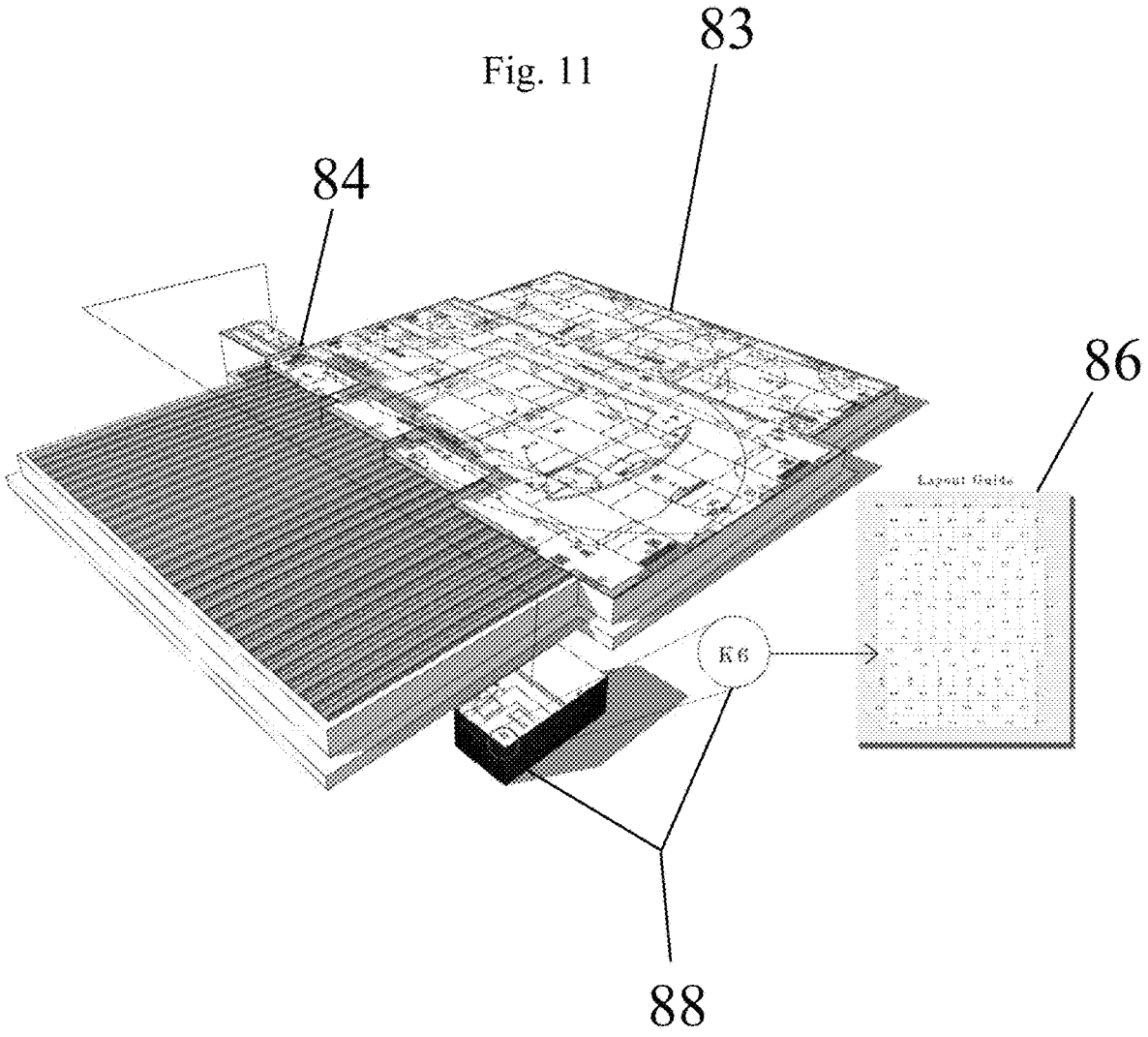
FIG. 11 illustrates the floor framing of FIG. 10 with the sub-floor sheathing installation partially complete.

FIG. 11 illustrates a partially assembled sub floor 83 including indication of sequential laying 84 of subfloor sheets. The sheets are being laid in association with a layout or key 86 that is indicates the position of each sheet of sheathing pursuant to an indicator 88 positioned on the corner of each sheet of sheathing.

Figure 12:
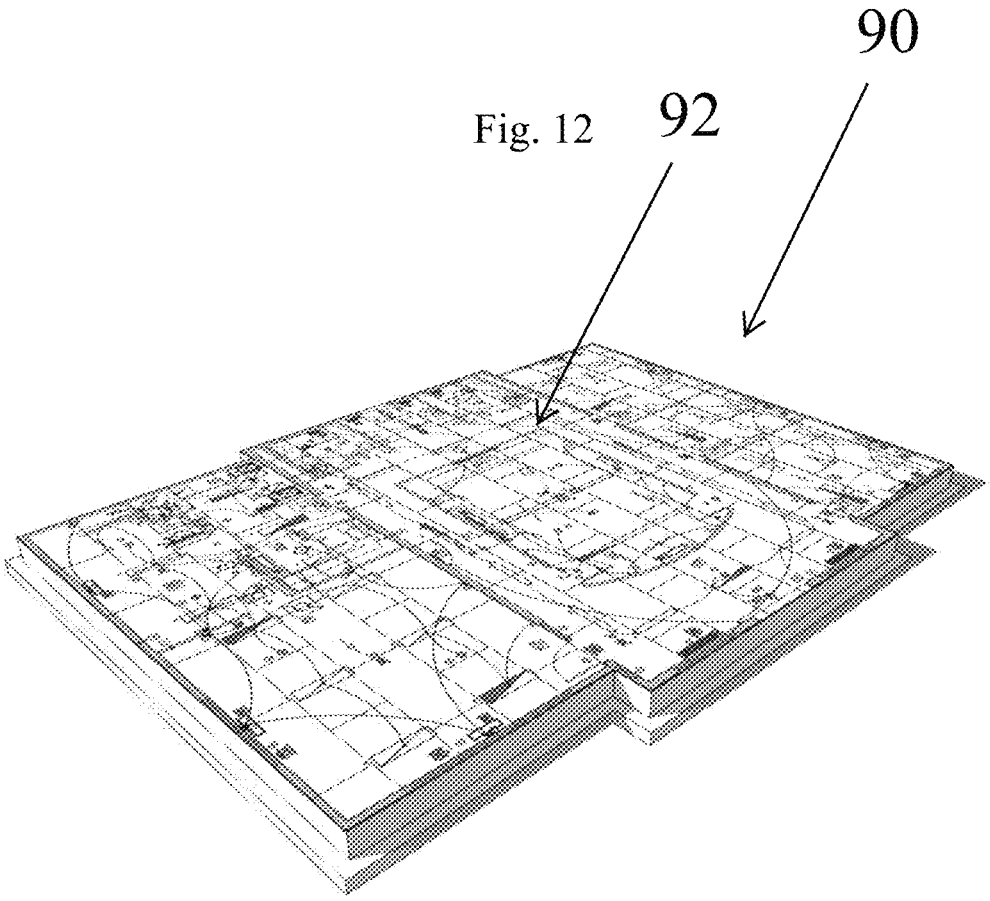
FIG. 12 illustrates the floor framing of FIG. 11 with the sub-floor sheathing fully installed.
Figure 13:
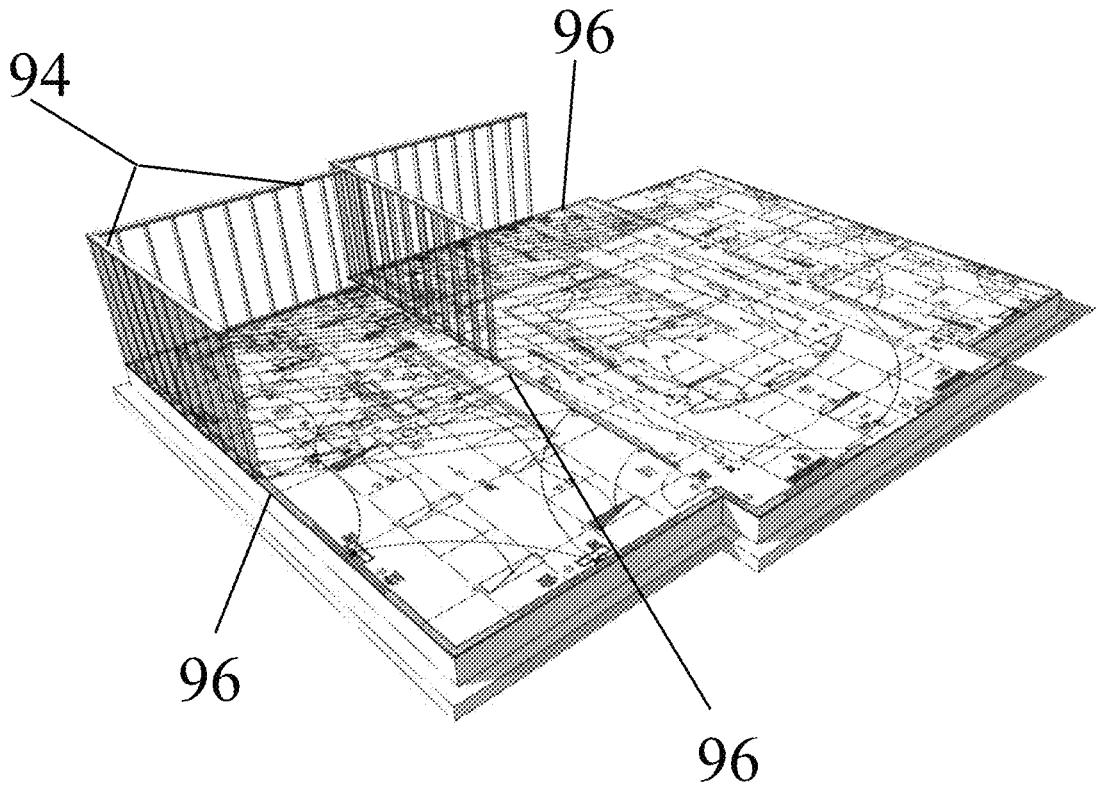
FIG. 13 illustrates the floor framing and installed sub-floor sheathing of FIG. 12 with walls being installed in accordance with the building plan depicted by the assembled sub-floor.

FIG. 12 illustrates a completed sub-floor assembly 90 displaying a full scale building plan 92. FIG. 13 illustrates sections of wall assembled within indicator markings of the assembled building plan on the assembled sub-floor.

While certain preferred embodiments are shown in the figures and described in this disclosure, it is to be distinctly understood that the presently disclosed inventive concept(s) is not limited thereto but may be variously embodied to practice within the scope of the following claims. From the foregoing description, it will be apparent that various changes may be made without departing from the spirit and scope of the disclosure as defined by the following claims.

We claim:

1. A method for installing a subfloor with pre-installed custom building information, said method comprising the following steps:

a first step of providing a plurality of sheathing panels configured for assembly as a surface of said building, wherein each of said sheathing panels comprises a tile of a tiled image of a building plan, wherein each of said tiles is pre-printed on a top surface of each of said sheathing panels such that each subpanel is printed with one tile of said tiled image of said building plan, wherein said sheathing panels are configured for assembly together to form a complete full scale plan for constructing of the building on said sheathing panels such that each of said sheathing panels forms a tile in the complete full scale plan for constructing of the building;

a second step of assembling said sheathing panels to form said surface of said building such that said tiled complete image of said building plan is displayed on said surface of the building.

2. The method of claim 1, wherein said sheathing panels comprise oriented strand board (OSB) panels.

3. The method of claim 1, wherein said sheathing panels comprise sub-floor panels.

4. The method of claim 1 wherein said building information comprises framing information, plumbing information, and electrical information.

5. The method of claim 1, wherein said sheathing panels comprise drywall sheathing.

6. The method of claim 1, wherein said sheathing panels comprise tile backer board.

7. The method of claim 1, wherein said sheathing panels comprise plywood.

8. The method of claim 1, wherein said step of providing a plurality of sheathing panels comprises printing a tile of said tiled image of said building plan onto said plurality of sheathing panels, with each tile of said tiled image being printed onto one of said sheathing panels.

9. The method of claim 1, wherein said step of providing a series of sheathing panels comprises generating a tiled image of said complete building plan, wherein each tile of said tiled image is scaled to be printed on one of said sheathing panels.

10. The method of claim 1, wherein each sheathing panel of said plurality of sheathing panels comprises an identification system to indicate a location of installation of each of said sheathing panels to form said building plan.

11. A system of sheathing for use in building construction said system comprising:

a plurality of sheets of sheathing configured for assembly as a wall, floor, ceiling, or roof of a building, wherein each sheet of said plurality of sheets of sheathing has a preprinted tile of a tiled image of a building plan printed thereon and each sheet of said plurality of sheets of sheathing comprises an indicator of the position of the sheet within a layout of said wall, floor, or roof, wherein each sheet of said plurality of sheets of sheathing is configured such that assembly of each of said sheets according to said indicator of the position of each sheet provides a full scale image of said building plan on said wall, floor, ceiling or roof formed by assembly of said plurality of sheets.

12. The system of sheathing of claim 11, wherein said sheets of sheathing comprise oriented strand board.

13. The system of sheathing of claim 12, wherein said sheets comprise drywall sheathing.

14. The system of sheathing of claim 13, wherein said sheets comprise plywood.

15. The system of sheathing of claim 11, wherein said building plan comprises at least one building information selected from the group consisting of plumbing information, framing information, and electrical information.

16. The method of claim 8 wherein printing said building information on each of said sheets of sheathing comprises engraving said building information on each of said panels of sheathing.

* * * * *